US008823249B2

(12) United States Patent
Nakamura et al.

(10) Patent No.: US 8,823,249 B2
(45) Date of Patent: Sep. 2, 2014

(54) IRRADIATION DEVICE AND IRRADIATION METHOD

(71) Applicant: Seiko Epson Corporation, Tokyo (JP)

(72) Inventors: Shinichi Nakamura, Okaya (JP); Seiji Kinoshita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/673,412

(22) Filed: Nov. 9, 2012

(65) Prior Publication Data

US 2013/0119851 A1 May 16, 2013

(30) Foreign Application Priority Data

Nov. 15, 2011 (JP) ..... 2011-249409
Nov. 15, 2011 (JP) ..... 2011-249410

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |
| ***H01J 17/28*** | (2006.01) |
| ***B41J 11/00*** | (2006.01) |
| *H01J 61/28* | (2006.01) |

(52) U.S. Cl.

CPC ..... *H01J 17/28* (2013.01); *H01J 61/28* (2013.01); *B41J 11/002* (2013.01)
USPC ..... 313/46; 313/22; 313/28; 313/39

(58) Field of Classification Search

USPC ..... 313/22
See application file for complete search history.

(56) References Cited

U.S. PATENT DOCUMENTS

| | | | | |
|---|---|---|---|---|
| 2005/0068361 | A1 | 3/2005 | Yokoyama | |
| 2005/0212400 | A1 * | 9/2005 | Iida et al. | 313/493 |
| 2005/0253914 | A1 * | 11/2005 | Yokoyama | 347/102 |

FOREIGN PATENT DOCUMENTS

| | | |
|---|---|---|
| JP | 07-042729 Y | 10/1995 |
| JP | 09-147805 | 6/1997 |
| JP | 2003-080687 | 3/2003 |
| JP | 2005-011740 | 1/2005 |
| JP | 2005-103845 | 4/2005 |
| JP | 2005-125752 | 5/2005 |
| JP | 2007-245653 | 9/2007 |
| JP | 2010-000735 | 1/2010 |
| JP | 2011-037025 | 2/2011 |
| JP | 2011-125797 | 6/2011 |

* cited by examiner

*Primary Examiner* — Donald Raleigh
(74) *Attorney, Agent, or Firm* — Workman Nydegger

(57) ABSTRACT

An irradiation device includes: a light source having an amalgam alloy member that is disposed on a part of the inner surface of a light source tube; and a chamber in which the light source is disposed. The chamber includes: a main chamber body; and a first gas inflow port and a first gas outflow port that are formed in the main chamber body. The first gas inflow port and the first gas outflow port are arranged so that the outer surface of the part of the light source tube where the amalgam alloy member is disposed is positioned in a flow path of a gas that flows in through the first gas inflow port and flows out through the first gas outflow port.

16 Claims, 6 Drawing Sheets

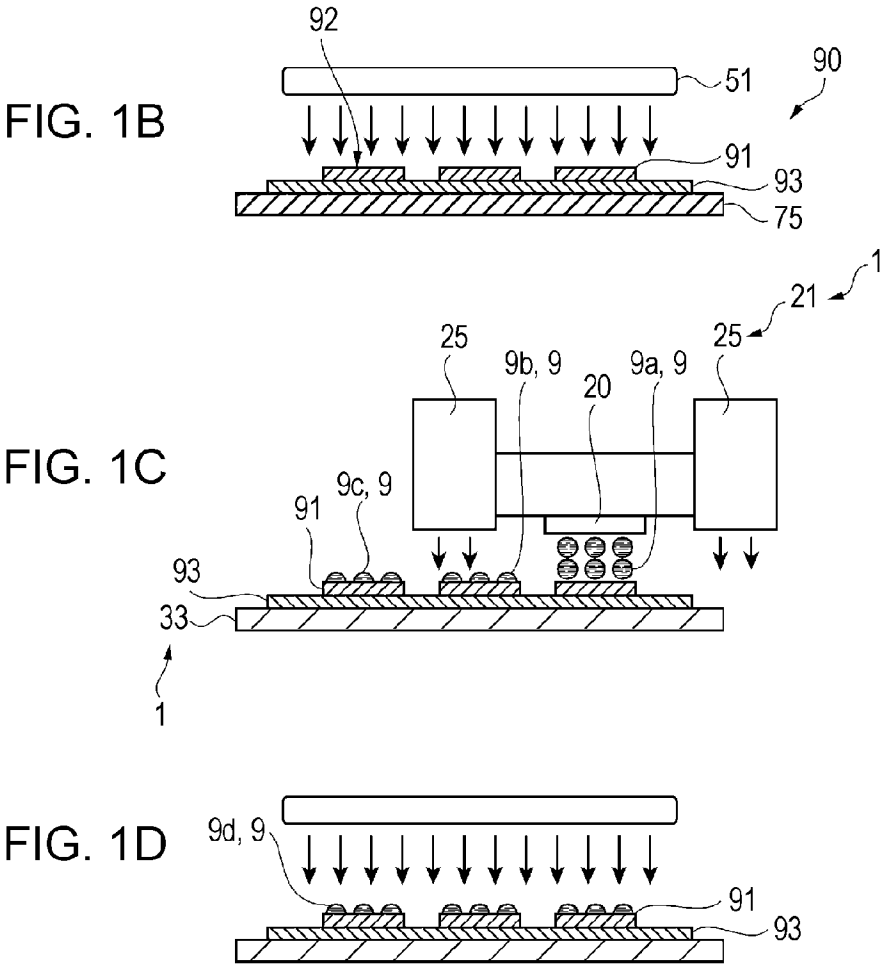
FIG. 1B
FIG. 1C
FIG. 1D
FIG. 1A
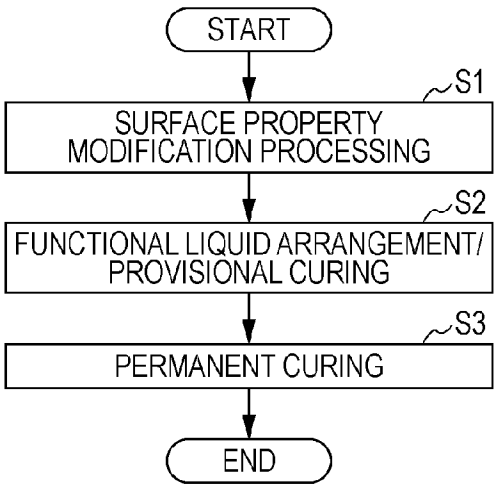

IRRADIATION DEVICE AND IRRADIATION METHOD

BACKGROUND

1. Technical Field

The present invention relates to irradiation devices equipped with light sources that emit ultraviolet light or the like, and irradiation methods for irradiating ultraviolet light or the like using light sources that emit ultraviolet light or the like.

2. Related Art

Image formation apparatuses that arrange functional liquid on an image-formation target medium by discharging the functional liquid as droplets and cure the arranged functional liquid so as to form an image or the like have been known. It is carried out that light curing-type functional liquid is used to be arranged, and is cured by the irradiation of curing light to the arranged functional liquid as a method for controlling a curing timing and curing time of the functional liquid. Further, it is also carried out to irradiate property modification light to an image formation surface of an image-formation target medium so as to control an expansion manner of the functional liquid that has landed on the image-formation target medium, affinity of the functional liquid with the image-formation target medium, or the like. In order to carry out the irradiation of such curing light and property modification light in a stabilized manner, a light source that emits the above-mentioned light is required to exhibit its performance in a stabilized manner.

In JP-A-2005-125752, there is disclosed an ink jet recording apparatus that includes: a recording head for discharging a light curing ink which is cured by the irradiation of ultraviolet light onto a recording medium; a light irradiation device equipped with a light source which irradiates ultraviolet light to the discharged ink; a cooling device which cools the light irradiation device; a temperature detection unit which detects a temperature of the light irradiation device; and a control unit which carries out temperature control on the cooling device according to a detected temperature given by the temperature detection unit, and that forms an image while stabilizing light emission efficiency of a low-output ultraviolet light source.

In JP-A-2010-735, there are disclosed an ultraviolet curing-type ink jet printer and light source units used in the ultraviolet curing-type ink jet printer that can provide a method which prevents a light source unit from getting dirty due to ink mist floating over a print medium so as to stably maintain an appropriate irradiation efficiency with the configuration as follows. That is, in the UV curing-type printer, the light source units, which are respectively installed on the right and left sides sandwiching a print head, each include a light source whose output surface faces the print medium and that emits ultraviolet light toward the print medium, a fan that blows the outside air introduced from above to the light source for cooling it, and a guide structure that guides the cooling air. The guide structure guides the air which was blown by the fan and has cooled the light source so that it flows along the output surface of the light source in a direction being distanced from the side of the vicinity of the print head.

However, the ink jet recording apparatus disclosed in JP-A-2005-125752 is needed to install a temperature detection unit or the like, which raises a problem in that the ink jet recording apparatus becomes complicated and larger in size. In addition, it is not certain that the temperature of a portion related to light source characteristics of the light source can be appropriately measured without blocking a traveling path of the emitted light. Therefore, there has been a problem that appropriate control cannot necessarily be carried out.

In the ultraviolet curing-type ink jet printer and the light source units for the ultraviolet curing-type ink jet printer disclosed in JP-A-2010-735, since the guide structure and the like are not tailored to the characteristics of the light sources, there has been a problem in that cooling operation cannot necessarily be carried out in an appropriate manner in order to favorably maintain a function of the light source.

SUMMARY

An advantage of some aspects of the invention is to solve at least part of the above problems, and the invention can be embodied in the following embodiments or application examples.

Application Example 1

An irradiation device according to this application example includes a light source having an amalgam alloy member that is disposed on a part of the inner surface of a light source tube and a chamber in which the light source is disposed; the chamber includes a main chamber body, and a first gas inflow port and a first gas outflow port that are formed in the main chamber body; the first gas inflow port and the first gas outflow port are arranged so that the outer surface of the part of the light source tube where the amalgam alloy member is disposed is positioned in a flow path of a gas that flows in through the first gas inflow port and flows out through the first gas outflow port.

According to the irradiation device of this application example, while a gas within the main chamber body is discharged through the first gas outflow port, a gas is supplied into the main chamber body through the first gas inflow port. The outer surface of the part of the light source tube where the amalgam alloy member is disposed is positioned in a flow path of the gas that flows in through the first gas inflow port and flows out through the first gas outflow port. The amalgam alloy member is configured of an amalgam alloy that is disposed, for example, in the form of an island on the inner wall of the light source tube. The light emitting characteristic of a light source having an amalgam alloy member (hereinafter, referred to as "amalgam light source") depends on a temperature of the amalgam alloy member. Because the outer surface of the part of the light source tube where the amalgam alloy member is disposed is positioned in the flow path of the gas that flows in through the first gas inflow port and flows out through the first gas outflow port, it is possible to adjust the temperature of the amalgam alloy member by the gas that flows in through the first gas inflow port and flows out through the first gas outflow port. Adjusting the temperature of the amalgam alloy member to an appropriate temperature at which favorable light emission can be carried out makes it possible for the amalgam light source to appropriately carry out the light emission. Adjusting the temperature of the amalgam alloy member makes it possible to carry out the temperature adjustment more efficiently in comparison with a case where the temperature of the overall amalgam light source is adjusted.

Application Example 2

In the irradiation device according to application example 1, it is preferable that the first gas inflow port and the first gas outflow port be arranged at the positions sandwiching the amalgam alloy member between the first gas inflow port and the first gas outflow port in a direction that intersects with an extension direction of the light source tube.

According to the irradiation device of this application example, the first gas inflow port and the first gas outflow port are arranged at the positions sandwiching the amalgam alloy member between the first gas inflow port and the first gas outflow port in a direction that intersects with the extension direction of the light source tube. This makes it possible to blow the gas, which flows in through the first gas inflow port and flows out through the first gas outflow port, from a side of the light source tube of the amalgam light source onto the part where the amalgam alloy member is disposed. Blowing the gas from the side of the light source tube onto the part where the amalgam alloy member is disposed makes it possible to efficiently adjust the temperature of the amalgam alloy member.

Application Example 3

In the irradiation device according to application example 1 or 2, it is preferable for the first gas outflow port to be arranged above the amalgam alloy member in the vertical direction and for the first gas inflow port to be arranged under the amalgam alloy member in the vertical direction.

According to the irradiation device of this application example, the first gas outflow port is arranged above the amalgam alloy member in the vertical direction and the first gas inflow port is arranged under the amalgam alloy member in the vertical direction. A gas becomes lighter as its temperature increases. Therefore, in the cooling of the amalgam alloy member, a gas that flows in through the first gas inflow port makes contact with the light source and cools the amalgam alloy member, resulting in an increase in temperature of the gas; then the gas flows out through the first gas outflow port. Since the first gas outflow port is arranged above and the first gas inflow port is arranged under the amalgam alloy member, the gas whose temperature is increased through cooling the amalgam alloy member can move and flow smoothly.

Application Example 4

In the irradiation device according to application example 1, 2 or 3, it is preferable for the light source to be equipped with a discharge electrode, for the chamber to further include a second gas inflow port and a second gas outflow port that are formed in the main chamber body, and for the second gas inflow port and the second gas outflow port to be arranged so that the outer surface of a portion of the light source tube where the discharge electrode is disposed is positioned in a flow path of a gas that flows in through the second gas inflow port and flows out through the second gas outflow port.

According to the irradiation device of this application example, the outer surface of the portion of the light source tube where the discharge electrode is disposed is positioned in a flow path of the gas that flows in through the second gas inflow port and flows out through the second gas outflow port. The lifespan of a light source equipped with a discharge electrode usually depends on the lifespan of the discharge electrode. The lifespan of the discharge electrode depends on its temperature. Since the outer surface of the portion of the light source tube where the discharge electrode is disposed is positioned in the flow path of the gas that flows in through the second gas inflow port and flows out through the second gas outflow port, it is possible to adjust the temperature of the discharge electrode by the gas that flows in through the second gas inflow port and flows out through the second gas outflow port. By adjusting the temperature of the discharge electrode to a temperature at which the lifespan of the discharge electrode is unlikely to be shortened, the lifespan of the light source can be prevented from being shortened due to an inappropriate temperature of the discharge electrode. Adjusting the temperature of the discharge electrode makes it possible to carry out the temperature adjustment more efficiently in comparison with a case where the temperature of the overall amalgam light source is adjusted.

Application Example 5

In the irradiation device according to application example 4, it is preferable for the second gas inflow port and the second gas outflow port to be arranged at the positions sandwiching the discharge electrode between the second gas inflow port and the second gas outflow port in a direction that intersects with the extension direction of the light source tube.

According to the irradiation device of this application example, the second gas inflow port and the second gas outflow port are arranged at the positions sandwiching the discharge electrode between the second gas inflow port and the second gas outflow port in a direction that intersects with the extension direction of the light source tube. This makes it possible to blow the air, which flows in through the second gas inflow port and flows out through the second gas outflow port, from a side of the light source tube of the amalgam light source onto the portion where the discharge electrode is disposed. By blowing the air from the side of the light source tube onto the portion where the discharge electrode is disposed, the temperature of the discharge electrode can be efficiently adjusted.

Application Example 6

In the irradiation device according to application example 5, it is preferable for the second gas outflow port to be arranged above the discharge electrode in the vertical direction, and for the second gas inflow port to be arranged under the discharge electrode in the vertical direction.

According to the irradiation device of this application example, the second gas outflow port is arranged above the discharge electrode in the vertical direction, and the second gas inflow port is arranged under the discharge electrode in the vertical direction. A gas becomes lighter as its temperature increases. Therefore, in the cooling of the discharge electrode, a gas that flows in through the second gas inflow port makes contact with the light source and cools the discharge electrode, resulting in an increase in temperature of the gas; then the gas flows out through the second gas outflow port. Since the second gas outflow port is arranged above and the second gas inflow port is arranged under the discharge electrode, the gas whose temperature is increased through cooling the discharge electrode can move and flow smoothly.

Application Example 7

In the irradiation device according to application example 4, 5 or 6, it is preferable that the amalgam alloy member be disposed at a position closer to a second end than to a first end, the second end being on the opposite side to the first end in the lengthwise direction of the light source, the discharge electrode be disposed inside the light source tube and include a first discharge electrode disposed at the first end side and a second discharge electrode disposed at the second end side, and the second gas inflow port and the second gas outflow port be disposed so that the outer surface of a portion of the light source tube where the first discharge electrode is disposed is arranged in a flow path of a gas that flows in through the second gas inflow port and flows out through the second gas outflow port.

According to the irradiation device of this application example, the second gas inflow port and the second gas outflow port are disposed so that the outer surface of the portion where the discharge electrode at the first end side is disposed is arranged in a flow path of the gas that flows in through the second gas inflow port and flows out through the second gas outflow port. This makes it possible to adjust the temperature of the discharge electrode disposed at the first end side by the gas that flows in through the second gas inflow port and flows out through the second gas outflow port.

The amalgam alloy member is disposed at a position closer to of the second end than to the first end, the second end being on the opposite side to the first end in the lengthwise direction of the light source. Therefore, the discharge electrode disposed at an end on the second end side inside the light source tube is positioned near the amalgam alloy member. This makes it possible to carry out temperature adjustment on the discharge electrode disposed on the second end side along with the temperature adjustment on the amalgam alloy member by the gas that flows in through the first gas inflow port and flows out through the first gas outflow port. Accordingly, the temperature of the discharge electrode disposed on the second end side can be adjusted without providing another second gas inflow port and second gas outflow port dedicated for adjusting the temperature of the discharge electrode disposed on the second end side, thereby making it possible to simplify the configuration of the irradiation device.

Application Example 8

In the irradiation device according to any one of application examples 1 through 7, it is preferable to further include a gas temperature adjustment unit capable of adjusting the temperature of a gas which is supplied to the main chamber body through at least one of the first gas inflow port and the second gas inflow port.

According to the irradiation device of this application example, it is possible to adjust the temperature of a gas that is supplied to the main chamber body by the gas temperature adjustment unit. By adjusting the temperature of the gas to a favorable temperature so as to make the amalgam alloy member and the discharge electrode at an appropriate temperature, the temperature of the amalgam alloy member and the discharge electrode can be adjusted to an appropriate temperature.

Application Example 9

In the irradiation device according to any one of application examples 1 through 8, it is preferable to further include a suction unit capable of sucking a gas within the main chamber body via at least one of the first gas outflow port and the second gas outflow port.

According to the irradiation device of this application example, it is possible to suck a gas within the main chamber body by the suction unit via the first gas outflow port or the second gas outflow port so as to cause the interior of the chamber to be in a negative pressure state.

Application Example 10

An irradiation method according to this application example is an irradiation method for irradiating light that is emitted from a light source including an amalgam alloy member which is disposed on a part of the inner surface of a light source tube, in which the outer surface of the part of the light source tube where the amalgam alloy member is disposed is positioned in an air flow of a gas that flows in through a first gas inflow port formed in a chamber where the light source is disposed and flows out through a first gas outflow port formed in the stated chamber.

According to the irradiation method of this application example, the outer surface of the part of the light source tube where the amalgam alloy member is disposed is positioned in the air flow of the gas that flows in through the first gas inflow port and flows out through the first gas outflow port. The amalgam alloy member is configured of an amalgam alloy that is disposed, for example, in the form of an island on the inner wall of the light source tube. The light emitting characteristic of an amalgam light source having an amalgam alloy member depends on a temperature of the amalgam alloy member. Because the outer surface of the part of the light source tube where the amalgam alloy member is disposed is positioned in the flow path of the gas that flows in through the first gas inflow port and flows out through the first gas outflow port, it is possible to adjust the temperature of the amalgam alloy member by the gas that flows in through the first gas inflow port and flows out through the first gas outflow port. Adjusting the temperature of the amalgam alloy member to an appropriate temperature at which favorable light emission can be carried out makes it possible for the amalgam light source to appropriately carry out the light emission. Adjusting the temperature of the amalgam alloy member makes it possible to carry out the temperature adjustment more efficiently in comparison with a case where the temperature of the overall light source is adjusted.

Application Example 11

An irradiation device according to this application example includes a light source equipped with an amalgam alloy member that is disposed on a part of the inner surface of a light source tube and a chamber inside of which the light source is disposed; the chamber includes a main chamber body, a first gas inflow port and a first gas outflow port that are formed in the main chamber body, and a first flow guidance member that guides a gas flowing into the main chamber body through the first gas inflow port to a direction in which the gas is blown onto the outer surface of the part of the light source tube where the amalgam alloy member is disposed.

According to the irradiation device of this application example, while a gas within the main chamber body is discharged through the first gas outflow port, a gas is supplied into the main chamber body through the first gas inflow port. The gas that flows into the main chamber body through the first gas inflow port is guided by the first flow guidance member to a direction in which it is blown onto the outer surface of the portion of the light source tube where the amalgam alloy member is disposed. This makes it possible for the outer surface of the part of the light source tube where the amalgam alloy member is disposed to be positioned in a flow path of the gas that flows in through the first gas inflow port and flows out through the first gas outflow port. The amalgam alloy member is configured of an amalgam alloy that is disposed, for example, in the form of an island on the inner wall of the light source tube. The light emitting characteristic of a light source equipped with an amalgam alloy member depends on a temperature of the amalgam alloy member. Because the outer surface of the part where the amalgam alloy member is disposed is positioned in the flow path of the gas that flows in through the first gas inflow port and flows out through the first gas outflow port, the temperature of the amalgam alloy member can be adjusted by the gas that flows in through the first gas inflow port and flows out through the first gas outflow port. By adjusting the temperature of the amalgam alloy member to an appropriate temperature at which preferable light emission can be carried out, the amalgam light source can appropriately carry out the light emission. Adjusting the temperature of the amalgam alloy member makes it possible to carry out the temperature adjustment more efficiently in comparison with a case where the temperature of the overall amalgam light source is adjusted.

Application Example 12

In the irradiation device according to application example 11, it is preferable for the first flow guidance member to include a first flow guidance path having a first opening at one end thereof being opened facing the first gas inflow port and a second opening at the other end thereof being opened facing the outer surface of the part of the light source tube where the amalgam alloy member is disposed.

According to the irradiation device of this application example, a gas that flows into the main chamber body through the first gas inflow port passes through the first gas inflow port and the first flow guidance path, and flows out through the second opening of the first flow guidance path which is opened facing the outer surface of the part of the light source tube where the amalgam alloy member is disposed, so that the gas blows against the light source tube to which the second opening faces. This makes it possible for the outer surface of the part of the light source tube where the amalgam alloy member is disposed to be positioned in a flow path of the gas that flows in through the first gas inflow port and flows out through the first gas outflow port.

Application Example 13

In the irradiation device according to application example 12, it is preferable for the first flow guidance member and the first gas outflow port to be arranged at the positions sandwiching the amalgam alloy member between the second opening and the first gas outflow port in a direction that intersects with the extension direction of the light source tube.

According to the irradiation device of this application example, the first flow guidance member and the first gas outflow port are arranged at the positions sandwiching the amalgam alloy member between the second opening of the first flow guidance path and the first gas outflow port in a direction that intersects with the extension direction of the light source tube. This makes it possible to blow a gas that flows in through the first gas inflow port to enter the main chamber body through the second opening of the first flow guidance path and flows out through the first gas outflow port, onto the part where the amalgam alloy member is disposed from the side of the light source tube of the amalgam light source. Blowing the gas onto the part where the amalgam alloy is disposed from the side of the light source tube makes it possible to efficiently adjust the temperature of the amalgam alloy member.

Application Example 14

In the irradiation device according to application example 12 or 13, it is preferable to provide a first flow regulator that restricts the blow of a gas that has passed through the first flow guidance member against the light source tube between the first flow guidance member and the light source tube.

According to the irradiation device of this application example, there is provided the first flow regulator that restricts the blow of the gas which has passed through the first flow guidance path against the light source tube.

In the case where an irradiation device includes a plurality of light sources, by making an irradiation target face the plurality of light sources, light can be efficiently irradiated to the target. In order for the irradiation target to face the plurality of light sources, it is advisable for the irradiation target to be placed at a position in a direction that intersects with a direction in which the plurality of light sources are aligned. In order to blow the air flow onto the light source tube without being blocked by the irradiation target, it is advisable for the first flow guidance member to be placed at a position on a line extended from the direction in which the light source tubes are aligned. In the case where the first flow guidance member is placed at a position on a line extended from the direction in which the light source tubes are aligned, the air flow directly blows against a first light source tube, which is the closest to the first flow guidance member; however, the air flow is unlikely to blow against a second light source tube and the subsequent light source tubes because the air flow is blocked by the first light source tube. Providing the first flow regulator makes it possible to restrict an amount of gas that is blown onto the first light source tube. The gas that is prevented from being blown onto the first light source tube by the first flow regulator flows toward the first gas outflow port, which causes the gas to be blown onto the second and subsequent light source tubes while bypassing the first light source tube. Through this, the temperature of the amalgam alloy members disposed in the second and subsequent light source tubes can be easily adjusted.

Application Example 15

In the irradiation device according to application example 14, it is preferable for the width of the first flow regulator to be smaller than the outer diameter of the light source tube in a direction which is approximately orthogonal both to the direction of the air flow that flows toward the light source tube from the first flow guidance member and to the extension direction of the light source tube.

According to the irradiation device of this application example, the width of the first flow regulator is smaller than the outer diameter of the light source tube in a direction which is approximately orthogonal both to the direction of the air flow that flows toward the light source tube from the first flow guidance member and to the extension direction of the light source tube. In other words, the width of the first flow regulator projected on the cross-section of the air flow is smaller than the outer diameter of the light source tube projected on the cross-section of the air flow.

Since the first flow regulator is disposed between the first flow guidance path and the light source tube, the first flow regulator and the light source tube are aligned in the direction of the air flow. In the case where the width of the first flow regulator is larger than the outer diameter of the light source tube, it is difficult to adjust the temperature of the first light source tube because most of the gas that would be blown onto the first light source tube without the first flow regulator is blocked by the first flow regulator. Note that the first light source tube is positioned closest to the first flow regulator. By making the width of the first flow regulator smaller than the outer diameter of the light source tube, it is possible to cause part of the gas that is blown onto the first light source tube, which is the closest to the first flow regulator, to bypass the first light source tube so that the temperature of both the first light source tube and the second and subsequent light source tubes can be adjusted with ease.

Application Example 16

In the irradiation device according to any one of application examples 11 through 15, it is preferable that the light source include a discharge electrode and that the aforementioned chamber further include a second gas inflow port and a second gas outflow port that are formed in the main chamber body, and a second flow guidance member that guides a gas flowing into the main chamber body through the second gas inflow port to a direction in which the gas is blown onto the outer surface of the portion of the light source tube where the discharge electrode is disposed.

According to the irradiation device of this application example, while a gas within the main chamber body is discharged through the second gas outflow port, a gas is supplied into the main chamber body through the second gas inflow port. The gas that flows into the main chamber body through the second gas inflow port is guided by the second flow guidance member to a direction in which it is blown onto the outer surface of the portion of the light source tube where the discharge electrode is disposed. This makes it possible for the outer surface of the portion of the light source tube where the discharge electrode is disposed to be positioned in a flow path of the gas that flows in through the second gas inflow port and flows out through the second gas outflow port. The lifespan of a light source equipped with a discharge electrode usually depends on the lifespan of the discharge electrode. The lifespan of the discharge electrode depends on a temperature of the discharge electrode. Since the outer surface of the portion of the light source tube where the discharge electrode is disposed is positioned in the flow path of the gas that flows in through the second gas inflow port and flows out through the second gas outflow port, it is possible to adjust the temperature of the discharge electrode by the gas that flows in through the second gas inflow port and flows out through the second gas outflow port. By adjusting the temperature of the discharge electrode to a temperature at which the lifespan of the discharge electrode is unlikely to be shortened, the lifespan of the light source can be prevented from being shortened due to an inappropriate temperature of the discharge electrode. Adjusting the temperature of the discharge electrode makes it possible to carry out the temperature adjustment more efficiently in comparison with a case where the temperature of the overall amalgam light source is adjusted.

Application Example 17

In the irradiation device according to application example 16, it is preferable for the second flow guidance member to include a second flow guidance path having a third opening at one end thereof being opened facing the second gas inflow port and a fourth opening at the other end thereof being opened facing the outer surface of the portion of the light source tube where the discharge electrode is disposed.

According to the irradiation device of this application example, a gas that flows into the main chamber body through the second gas inflow port passes through the second gas inflow port and the second flow guidance path, and flows out through the fourth opening of the second flow guidance path which is opened facing the outer surface of the portion of the light source tube where the discharge electrode is disposed, so that the gas blows against the light source tube to which the fourth opening faces. This makes it possible for the outer surface of the portion of the light source tube where the discharge electrode is disposed to be positioned in a flow path of the gas that flows in through the second gas inflow port and flows out through the second gas outflow port.

Application Example 18

In the irradiation device according to application example 17, it is preferable for the second flow guidance member and the second gas outflow port to be arranged at the positions sandwiching the discharge electrode between the fourth opening and the second gas outflow port in a direction that intersects with the extension direction of the light source tube.

According to the irradiation device of this application example, the second flow guidance member and the second gas outflow port are arranged at the positions sandwiching the discharge electrode between the fourth opening of the second flow guidance path and the second gas outflow port in a direction that intersects with the extension direction of the light source tube. This makes it possible to blow a gas that flows in through the second gas inflow port to enter the main chamber body through the fourth opening of the second flow guidance path and flows out through the second gas outflow port, onto the portion where the discharge electrode is disposed from the side of the light source tube of the amalgam light source. Blowing the gas onto the portion where the discharge electrode is disposed from the side of the light source tube makes it possible to efficiently adjust the temperature of the discharge electrode.

Application Example 19

In the irradiation device according to application example 17 or 18, it is preferable to provide a second flow regulator that restricts the blow of a gas that has passed through the second flow guidance path against the light source tube between the second flow guidance member and the light source tube.

According to the irradiation device of this application example, there is provided the second flow regulator that restricts the blow of the gas which has passed through the second flow guidance path against the light source tube.

In the case where an irradiation device includes a plurality of light sources, by making an irradiation target face the plurality of light sources, light can be efficiently irradiated to the target. In order for the irradiation target to face the plurality of light sources, it is advisable for the irradiation target to be placed at a position the direction to which intersects with a direction in which the plurality of light sources are aligned. In order to blow the air flow onto the light source tube without being blocked by the irradiation target, it is advisable for the second flow guidance member to be placed at a position on a line extended from the direction in which the light source tubes are aligned. In the case where the second flow guidance member is placed at a position on a line extended from the direction in which the light source tubes are aligned, the air flow directly blows against a first light source tube which is the closest to the second flow guidance member; however, the air flow is unlikely to blow against a second light source tube and the subsequent light source tubes because the air flow is blocked by the first light source tube. Providing the second flow regulator makes it possible to restrict the amount of a gas that is blown onto the first light source tube. The gas that is prevented from being blown onto the first light source tube by the second flow regulator flows toward the second gas outflow port, which causes the gas to be blown onto the second and subsequent light source tubes while bypassing the first light source tube. Through this, the temperature of the discharge electrodes disposed in the second and subsequent light source tubes can be easily adjusted.

Application Example 20

In the irradiation device according to application example 19, it is preferable for the width of the second flow regulator to be smaller than the outer diameter of the light source tube in a direction which is approximately orthogonal both to the direction of the air flow that flows toward the light source tube from the second flow guidance member and to the extension direction of the light source tube.

According to the irradiation device of this application example, the width of the second flow regulator is smaller than the outer diameter of the light source tube in a direction which is approximately orthogonal both to the direction of the air flow that flows toward the light source tube from the second flow guidance member and to the extension direction of the light source tube. In other words, the width of the second flow regulator projected on a surface that is approximately orthogonal to the direction in which the air flow flows, is smaller than the outer diameter of the light source tube projected on the above surface.

Since the second flow regulator is disposed between the second flow guidance path and the light source tube, the second flow regulator and the light source tube are aligned in the direction of the air flow. In the case where the width of the second flow regulator is larger than the outer diameter of the light source tube, it is difficult to adjust the temperature of the first light source tube because the most of the gas that would be blown onto the first light source tube without the second flow regulator is blocked by the second flow regulator. Note that the first light source tube is positioned closest to the second flow regulator. By making the width of the second flow regulator smaller than the outer diameter of the light source tube, it is possible to cause part of the gas that is blown onto the first light source tube, which is the closest to the second flow regulator, to bypass the first light source tube so that the temperature of both the first light source tube and the second and subsequent light source tubes can be adjusted with ease.

BRIEF DESCRIPTION OF THE DRAWINGS

The invention will be described with reference to the accompanying drawings, wherein like numbers reference like elements.

FIG. 1A is a flowchart of an image formation process; FIG. 1B is a descriptive diagram illustrating image formation preprocessing; FIG. 1C is a descriptive diagram illustrating print processing; and FIG. 1D is a descriptive diagram illustrating curing processing.

DESCRIPTION OF EXEMPLARY EMBODIMENTS

Figure 2:
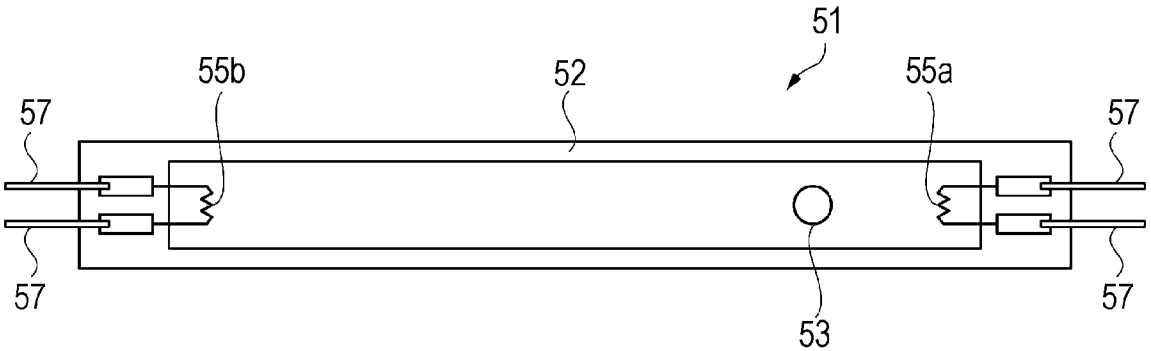
FIG. 2 is a descriptive diagram illustrating the major configuration of an amalgam lamp.

Hereinafter, an embodiment of an irradiation device and an irradiation method according to the invention will be described with reference to the drawings. The embodiment is explained exemplifying a preprocessor that is included in an image formation unit; the image formation unit includes a droplet discharge device that discharges functional liquid as a droplet, and forms an image or the like by arranging the functional liquid on arbitrary positions in an image-formation target medium using the droplet discharge device. The preprocessor is an ultraviolet irradiation device that irradiates ultraviolet light to an image formation surface of an image-formation target medium so as to modify properties of the image formation surface, remove foreign matter present thereon or the like. It is to be noted that in the drawings referred to in the following description, scales of lengthwise and breadthwise size of the constituent members and portions are different from the actual scales in some case for the sake of convenience in illustration.

Image Formation Process

First, an example of an image formation process that forms an image on an image-formation target medium will be described referring to FIGS. 1A through 1D. FIGS. 1A through 1D are descriptive diagrams in which each individual processing in the image formation process is illustrated. FIG. 1A is a flow chart of the image formation process, FIG. 1B is a descriptive diagram illustrating image formation preprocessing, FIG. 1C is a descriptive diagram illustrating print processing, and FIG. 1D is a descriptive diagram illustrating curing processing.

In a package member 90 as an image-formation target medium, semiconductor packages 91 are aligned and fixed to a transport substrate 93. The surface on the opposite side to a print surface 92 of each semiconductor package 91 is fixed to the transport substrate 93. A product model number or the like is printed on the print surface 92 in the image formation process.

In step S1 of FIG. 1A, a surface property modification processing as preprocessing is carried out. As shown in FIG. 1B, when the surface property modification processing is carried out, the package member 90 is held by a medium holder 75 of a preprocessor 40 (see FIGS. 3A and 3B). The package member 90 held by the medium holder 75 is made to face an amalgam lamp 51, property modification light emitted from the amalgam lamp 51 is irradiated to the print surface 92, and then a property of the print surface 92 is modified. The amalgam lamp 51 is an ultraviolet lamp and the property modification light emitted therefrom is ultraviolet light. By irradiating ultraviolet light to the print surface 92, the print surface 92 is changed to be lyophilic with respect to functional liquid 9 used for printing an image, for example.

Next, in step S2 of FIG. 1A, the functional liquid 9 is placed on the print surface 92 so as to print a product model number or the like. As shown in FIG. 1C, the package member 90 is placed on and held by a medium rest 33 of a droplet discharge device 1. While a droplet discharge head 20 included in a head unit 21 facing the print surface 92, the droplet discharge head 20 discharges the functional liquid 9 as a droplet 9*a* so as to land the liquid on the print surface 92.

By moving the medium rest 33 in a medium scanning direction by a medium scanning mechanism, the package member 90 placed on the medium rest 33 is moved freely in the medium scanning direction, and is held at a position to which it is moved. By moving the head unit 21 in a head scanning direction by a head scanning mechanism, the droplet discharge head 20 included in the head unit 21 is moved freely in the head scanning direction, and is held at a position to which it is moved.

In preparation for the printing, the medium rest 33 or the head unit 21 is moved so as to locate the liquid droplet discharge head 20 and the package member 90 at a discharge start position. Next, the droplet discharge head 20 and the medium rest 33 (package member 90) are relatively moved in a discharge scanning direction, and when they come to have a predetermined relative-positional relationship, the functional liquid 9 is discharged as the droplet 9*a* from the droplet discharge head 20 and is landed on the print surface 92. By relatively controlling the movement by the medium scanning mechanism and the movement by the head scanning mechanism, it is possible to land the droplet 9*a* at an arbitrary position on the package member 90, i.e., an arbitrary position on the print surface 92 of the semiconductor package 91 so as to form a desired image or the like.

The head unit 21 also includes ultraviolet irradiation units 25. The two ultraviolet irradiation units 25 included in the head unit 21 are respectively arranged at the positions sandwiching the droplet discharge head 20 in the discharge scanning direction. The ultraviolet irradiation unit 25 can irradiate ultraviolet light to the package member 90 from a location facing the medium rest 33.

By irradiating ultraviolet light from the ultraviolet irradiation unit 25 to the package member 90 along with discharging the droplet 9*a* from the droplet discharge head 20 at approximately the same time, functional liquid 9*b* that has landed on the print surface 92 is cured and becomes functional liquid 9*c* which is provisionally cured. The functional liquid 9*c* is the functional liquid 9 which has been cured to more than the extent that it does not fluidize even if the posture of the package member 90 is changed.

Subsequently, in step S3 of FIG. 1A, the functional liquid 9*c* is permanently cured. As shown in FIG. 1D, like in the surface property modification processing described above, the package member 90 is held by a medium holder of a permanent curing device. The package member 90 held by the medium holder is made to face a light source (ultraviolet lamp) that emits curing light (ultraviolet light), ultraviolet light emitted from the ultraviolet lamp is irradiated to the functional liquid 9*c* on the print surface 92, and then the functional liquid 9*c* is cured and becomes functional liquid 9*d* which is permanently cured. The functional liquid 9*d* is the functional liquid 9 which has been cured at a curing rate of 90% or more, for example.

Amalgam Lamp

Next, the configuration of the amalgam lamp 51 is described with reference to FIG. 2. FIG. 2 is a descriptive diagram illustrating the major configuration of the amalgam lamp 51. Here, the amalgam lamp 51 is a low-pressure mercury lamp.

As shown in FIG. 2, the amalgam lamp 51 is formed in a bar-like shape in which electrode pins 57 protrude from both sides of a glass tube 52. The glass tube 52 is a tube formed of quartz glass and both ends of the tube are sealed. The interior of the glass tube 52 is filled with an argon gas. A discharge electrode 55*a* is disposed at one end of the interior of the glass tube 52, and a discharge electrode 55*b* is disposed at the other end thereof. Both ends of the discharge electrode 55*a* and both ends of the discharge electrode 55*b* are electrically connected with the electrode pins 57, respectively. An amalgam spot 53 configured of a mercury amalgam that is disposed in the form of an island is formed on the inner wall of the glass tube 52. The amalgam spot 53 is formed at a position further than the center of the glass tube 52 toward the end side where the discharge electrode 55*a* is formed in the glass tube 52.

By connecting the discharge electrodes 55*a* or 55*b* with a power supply via the electrode pins 57 and making an electric current flow in the discharge electrode 55*a* or 55*b*, electrons are emitted from the discharge electrode 55*a* or 55*b*. The emitted electrons move to the discharge electrode 55*a* or 55*b* on the opposite side, which causes discharge to start. Electrons that are caused to flow by the discharge collide with mercury electrons. The mercury electrons generate ultraviolet light when collided with the electrons. Since an AC source is used as the power supply, the discharge electrodes 55*a* and 55*b* are formed in approximately the same shape.

The amalgam lamp 51 corresponds to the light source. The glass tube 52 corresponds to the light source tube. The amalgam spot 53 corresponds to the amalgam alloy member. An extension direction of the glass tube 52 corresponds to the extension direction of the light source tube.

An end on the side where the discharge electrode 55*a* is formed in the glass tube 52 corresponds to the second end, while an end on the side where the discharge electrode 55*b* is formed in the glass tube 52 corresponds to the first end.

Preprocessor

Figure 3B:
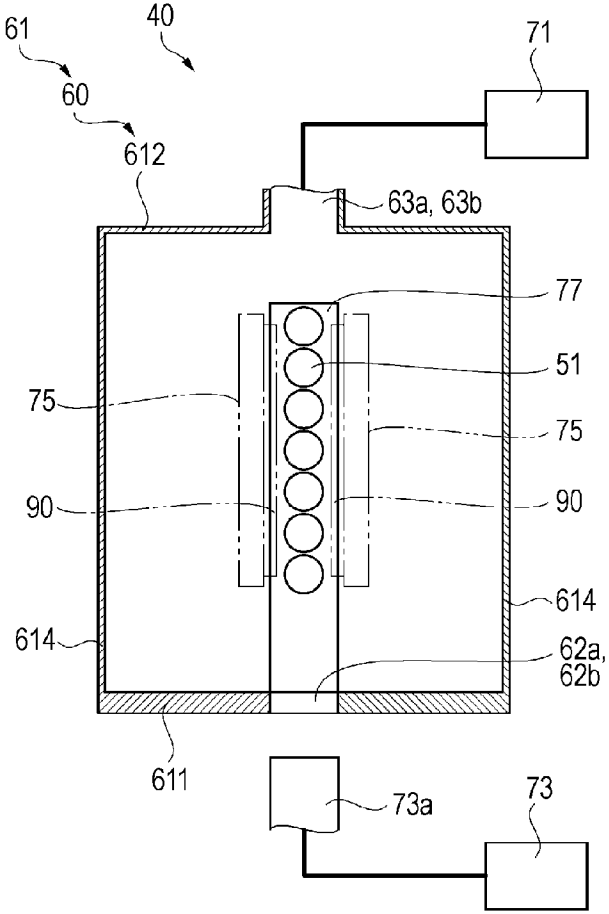
FIG. 3B is a descriptive diagram illustrating the configuration of the preprocessor, in which the shape of a cross section of the chamber cut along a plane approximately orthogonal to the extension direction of the amalgam lamp is illustrated.
Figure 3A:
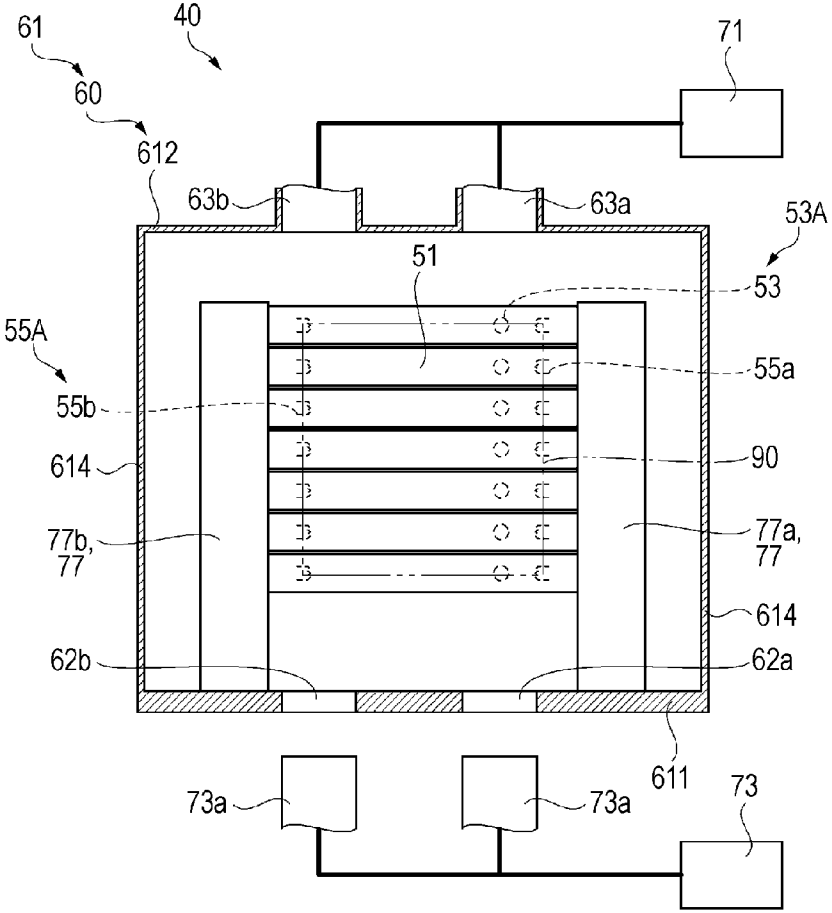
FIG. 3A is a descriptive diagram illustrating the configuration of a preprocessor, in which the shape of a cross section of a chamber cut along a plane approximately parallel to an extension direction of an amalgam lamp is illustrated.

Next, the preprocessor 40 will be described with reference to FIGS. 3A and 3B. FIGS. 3A and 3B are descriptive diagrams illustrating the configuration of the preprocessor 40. FIG. 3A is a descriptive diagram illustrating the configuration of the preprocessor 40, in which the shape of a cross section of a chamber cut along a plane approximately parallel to the extension direction of an amalgam lamp is illustrated, and FIG. 3B is a descriptive diagram illustrating the configuration of the preprocessor 40, in which the shape of a cross section of the chamber cut along a plane approximately orthogonal to the extension direction of the amalgam lamp is illustrated. For the sake of simplifying the drawing, only the outer shape of the glass tube 52 is indicated in the amalgam lamp 51 of FIG. 3B.

As shown in FIGS. 3A and 3B, the preprocessor 40 includes a chamber 61, the amalgam lamps 51, a lamp holder 77, the medium holder 75, a suction pump 71, and a temperature adjustment unit 73.

The chamber 61 includes a main chamber body 60 formed in a box shape of an approximately rectangular parallelepiped. The main chamber body 60 includes a floor wall 611 configuring a floor surface, a top wall 612 configuring a top surface which is opposed to the floor surface, and four side walls 614 connecting the floor wall 611 and the top wall 612.

The lamp holder 77 is disposed in the main chamber body 60. Holding frames 77*a* and 77*b* that configure the lamp holder 77 are erected on the floor wall 611 in the main chamber body 60. The holding frames 77*a* and 77*b* each include sockets into which the electrode pins 57 can be fitted, and the sockets included in each holding frame are opposed to each other. The electrode pins 57 of the amalgam lamp 51 are fitted into the sockets formed in the holding frames 77*a* and 77*b*, thus the amalgam lamp 51 is supported in a manner such that it is plugged and hung between the holding frames 77*a* and 77*b*. The preprocessor 40 includes seven amalgam lamps 51. The seven amalgam lamps 51 are arranged approximately in the vertical direction and form a wall-like structure.

The package member 90 is erected approximately vertical and held by the medium holder 75. By holding the package member 90 in a state of being erected, it is possible to make the package member 90 face the seven amalgam lamps 51 arranged in the vertical direction. The preprocessor 40 has two medium holders 75. Using the two medium holders 75, it is possible to make the package members 90 face the amalgam lamps 51 from both sides of the wall of the seven amalgam lamps 51. By emitting ultraviolet light from the amalgam lamp 51 to irradiate the ultraviolet light to the package member 90 (print surface 92) facing the amalgam lamp 51, the print surface 92 is changed to be lyophilic with respect to functional liquid used for printing the image, for example. The medium holder 75 can enter/exit the main chamber body 60 while holding the package member 90 through a medium gateway (not shown) formed in the side wall 614.

The main chamber body 60 includes an inflow port 62*a*, an inflow port 62*b*, an outflow port 63*a*, and an outflow port 63*b*.

The inflow ports 62*a* and 62*b* are openings formed in the floor wall 611. The outflow ports 63*a* and 63*b* are openings formed in the top wall 612.

In the preprocessor 40, the seven amalgam lamps 51 are arranged approximately in the vertical direction. The amalgam spots 53 formed in the amalgam lamps 51 are also arranged approximately in the vertical direction. Hereinafter, a row of the seven amalgam spots 53 is referred to as an "amalgam spot row 53A". The amalgam spot row 53A extends approximately vertical.

The discharge electrodes 55*a* and 55*b* formed in the amalgam lamps 51 are also arranged approximately in the vertical direction. A row of the discharge electrodes 55*a* and 55*b* formed in the seven amalgam lamps 51 is referred to as a "discharge electrode row 55A". The discharge electrode row 55A of the discharge electrodes 55*a* and 55*b* also extends approximately vertically.

The inflow port 62*a* is opened under the seven amalgam spots 53 arranged in the vertical direction, and the outflow port 63*a* is opened above the seven amalgam spots 53 arranged in the vertical direction. To rephrase, the inflow port 62*a* and the outflow port 63*a* are opened at positions where an extended line of the amalgam spot row 53A intersects with the floor wall 611 or the top wall 612.

The inflow port 62*b* is opened under the seven discharge electrodes 55*b* arranged in the vertical direction, and the outflow port 63*b* is opened above the seven discharge electrodes 55*b* arranged in the vertical direction. To rephrase, the inflow port 62*b* and the outflow port 63*b* are opened at the positions where an extended line of the discharge electrode row 55A intersects with the floor wall 611 or the top wall 612.

The outflow port 63*a* is opened above the seven amalgam spots 53 arranged in the vertical direction. Accordingly, the outflow port 63*a* is opened at a position including a point where an extended line of the amalgam spot row 53A intersects with the top wall 612.

The outflow port 63*b* is opened above the seven discharge electrodes 55*b* arranged in the vertical direction. Accordingly, the outflow port 63*b* is opened at a position including a point where the extended line of the discharge electrode row 55A of the discharge electrodes 55*b* intersects with the top wall 612.

The outflow ports 63*a* and 63*b* are connected with the suction pump 71. By driving the suction pump 71, air within the main chamber body 60 is discharged through the outflow port 63*a* or 63*b*. Air flows into the main chamber body 60 through the inflow ports 62*a* and 62*b* to refill it in place of the air that has been discharged through the outflow ports 63*a* and 63*b*. An air flow from the inflow port 62*a* to the outflow port 63*a* and an air flow from the inflow port 62*b* to the outflow port 63*b* are formed in the main chamber body 60.

The inflow port 62*a* is opened under the seven amalgam spots 53, and the outflow port 63*a* is opened above the seven amalgam spots 53. This causes the outer surface of the part of the glass tube 52 where the amalgam spot 53 is disposed to be positioned in the air flow from the inflow port 62*a* to the outflow port 63*a*.

The inflow port 62*b* is opened under the seven discharge electrodes 55*b*, and the outflow port 63*b* is opened above the seven discharge electrodes 55*b*. This caused the outer surface of the portion of the glass tube 52 where the discharge electrode 55*b* is disposed to be positioned in the air flow from the inflow port 62*b* to the outflow port 63*b*.

The inflow port 62*a* corresponds to the first gas inflow port. The inflow port 62*b* corresponds to the second gas inflow port. The outflow port 63*a* corresponds to the first gas outflow port. The outflow port 63*b* corresponds to the second gas outflow port. The suction pump 71 corresponds to the suction unit.

The temperature adjustment unit 73 is a unit that adjusts a temperature of air and is provided separate from the main chamber body 60. Discharge ports 73*a* through which the air whose temperature has been adjusted in the temperature adjustment unit 73 is discharged, are opened facing the inflow ports 62*a* and 62*b*. Most of the air that is discharged through the discharge ports 73*a* flows into the main chamber body 60 through the inflow port 62*a* or 62*b*. Most of the air that flows into the main chamber body 60 through the inflow ports 62*a* and 62*b* is the air whose temperature has been adjusted by the temperature adjustment unit 73.

The temperature adjustment unit 73 corresponds to the gas temperature adjustment unit. The preprocessor 40 corresponds to the irradiation device.

Example 1 of Other Preprocessors

Figure 5B:
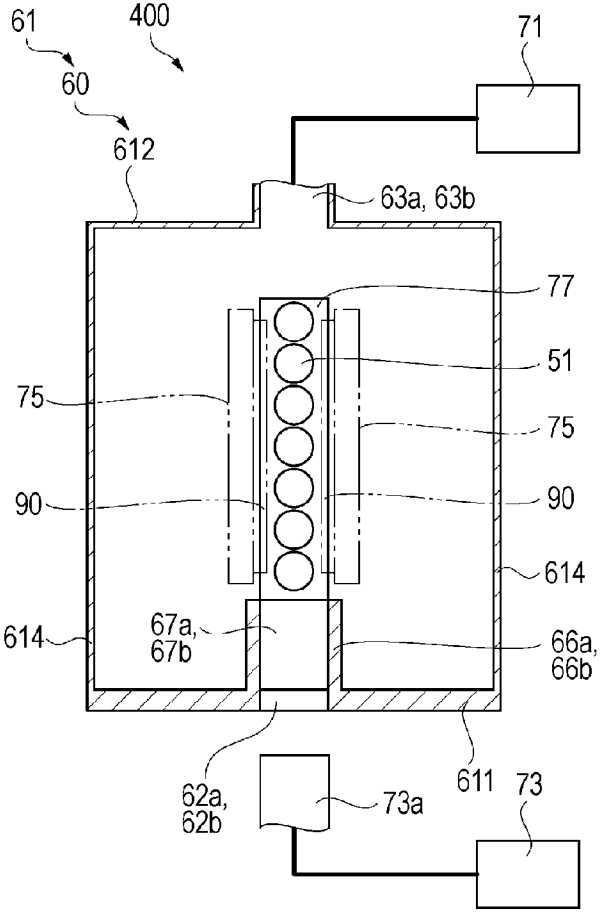
FIG. 5B is a descriptive diagram illustrating the configuration of the preprocessor, in which the shape of a cross section of the chamber cut along a plane approximately orthogonal to the extension direction of the amalgam lamp is illustrated.
Figure 5A:
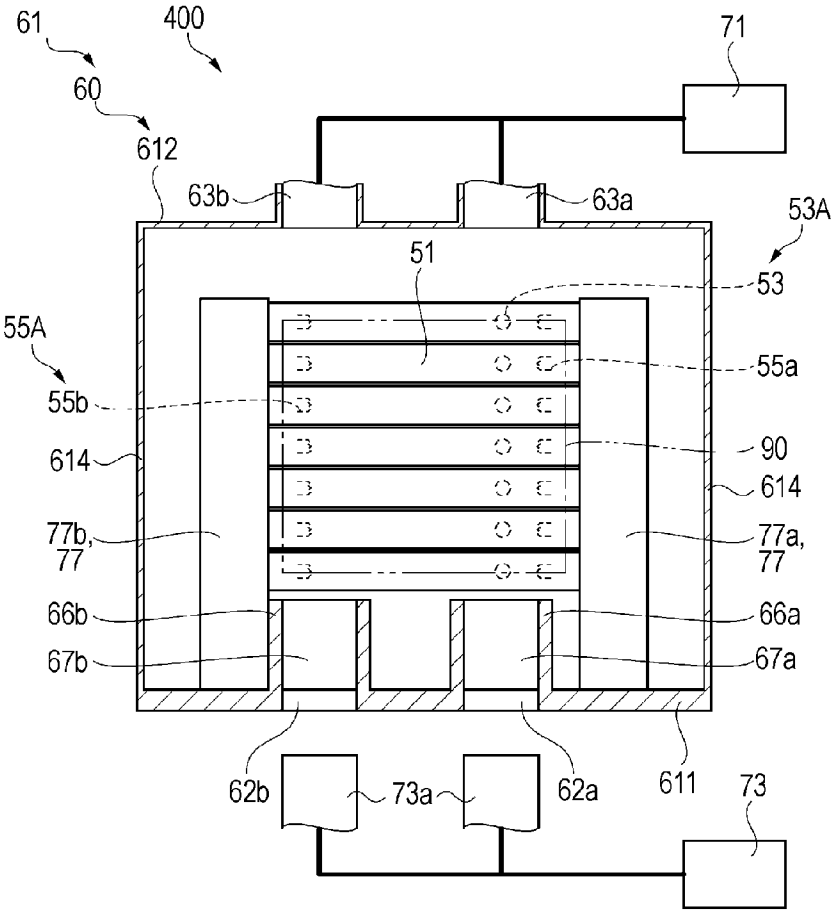
FIG. 5A is a descriptive diagram illustrating the configuration of a preprocessor, in which the shape of a cross section of a chamber cut along a plane approximately parallel to the extension direction of an amalgam lamp is illustrated.

Next, a preprocessor 400 will be described with reference to FIGS. 5A and 5B. Part of the configuration of the preprocessor 400 is different from that of the preprocessor 40 described above. In FIGS. 5A and 5B, same constituent elements as those in FIGS. 3A and 3B are given same reference numerals as those in FIGS. 3A and 3B and descriptions thereof will be omitted. FIG. 5A is a descriptive diagram illustrating the configuration of the preprocessor 400, in which the shape of a cross section of a chamber cut along a plane approximately parallel to the extension direction of the amalgam lamp is illustrated; and FIG. 5B is a descriptive diagram illustrating the configuration of the preprocessor 400, in which the shape of a cross section of the chamber cut along a plane approximately orthogonal to the extension direction of the amalgam lamp is illustrated. For the sake of simplifying the drawings, only the outer shape of the glass tube 52 is indicated in the amalgam lamp 51 of FIG. 5B.

The preprocessor 400 of FIGS. 5A and 5B differs from the preprocessor 40 of FIGS. 3A and 3B in that the main chamber body 60 of the preprocess 400 further includes flow guidance members 66*a* and 66*b*, and flow guidance paths 67*a* and 67*b*.

The flow guidance members 66*a* and 66*b* are tubes erected on the floor wall 611. The flow guidance paths 67*a* and 67*b* are hollow portions of the tube-shaped flow guidance members 66*a* and 66*b*.

The flow guidance path 67*a* communicates with the inflow port 62*a*, and the inflow port 62*a* and the flow guidance path 67*a* in combination penetrate from the outer surface to the inner surface of the main chamber body 60. Likewise, the flow guidance path 67*b* communicates with the inflow port 62*b*, and the inflow port 62*b* and the flow guidance path 67*b* in combination penetrate from the outer surface to the inner surface of the main chamber body 60. The flow guidance paths 67*a*, 67*b* and the floor wall 611 may be integrally formed, or may be separately formed and thereafter connected with each other.

The flow guidance member 66*a* is positioned under the seven amalgam spots 53 arranged in the vertical direction. The upper end of the flow guidance member 66*a* is positioned immediately under the lowermost amalgam lamp 51. The flow guidance path 67*a*, which is opened in the upper end surface of the flow guidance member 66*a*, is opened extremely near the lowermost amalgam lamp 51 facing the outer surface of the part of the glass tube 52 where the amalgam spot 53 is formed. The flow guidance path 67*a* is opened in the upper end surface of the flow guidance member 66*a* at a position including a point where an extended line of the amalgam spot row 53A intersects with the upper end surface of the flow guidance member 66*a*.

The flow guidance member 66*b* is positioned under the seven discharge electrodes 55*b* arranged in the vertical direction. The upper end of the flow guidance member 66*b* is positioned extremely near the lowermost amalgam lamp 51. The flow guidance path 67*b*, which is opened in the upper end of the flow guidance member 66*b*, is opened extremely near the lowermost amalgam lamp 51 facing the outer surface of the portion of the glass tube 52 where the discharge electrode 55*b* is formed. The flow guidance path 67*b* is opened in the upper end surface of the flow guidance member 66*b* at a position including a point where an extended line of the discharge electrode row 55A intersects with the upper end surface of the flow guidance member 66*b*.

The outflow ports 63*a* and 63*b* are connected with the suction pump 71. By driving the suction pump 71, air within the main chamber body 60 is discharged through the outflow port 63*a* or 63*b*. Air flows into the main chamber body 60 through the inflow ports 62*a* and 62*b* to refill it in place of the air that has been discharged through the outflow ports 63*a* and 63*b*. An air flow from the inflow port 62*a* to the outflow port 63*a* via the flow guidance path 67*a* and an air flow from the inflow port 62*b* to the outflow port 63*b* via the flow guidance path 67*b* are formed in the main chamber body 60.

The flow guidance path 67*a* is opened under the seven amalgam spots 53, and the outflow port 63*a* is opened above the seven amalgam spots 53. An opening of the flow guidance path 67*a* and the outflow port 63*a* are arranged sandwiching the amalgam spot row 53A in the extension direction of the amalgam spot row 53A. With this, an air flow from the flow guidance path 67*a* to the outflow port 63*a* flows along the amalgam spot row 53A, and the outer surface of the part of the glass tube 52 where the amalgam spot 53 is disposed is positioned in the air flow from the flow guidance path 67*a* to the outflow port 63*a*.

The flow guidance path 67*b* is opened under the seven discharge electrodes 55*b*, and the outflow port 63*b* is opened above the seven discharge electrodes 55*b*. An opening of the flow guidance path 67*b* and the outflow port 63*b* are arranged sandwiching the discharge electrode row 55A in the extension direction of the discharge electrode row 55A. With this, an air flow from the flow guidance path 67*b* to the outflow port 63*b* flows along the discharge electrode row 55A, and the outer surface of the portion of the glass tube 52 where the discharge electrode 55*b* is disposed is positioned in the air flow from the flow guidance path 67*b* to the outflow port 63*b*.

The flow guidance member 66*a* corresponds to the first flow guidance member. The flow guidance member 66*b* corresponds to the second flow guidance member. The flow guidance path 67*a* corresponds to the first flow guidance path. The flow guidance path 67*b* corresponds to the second flow guidance path. The opening of the flow guidance path 67*a* facing the inflow port 62*a* corresponds to the first opening. An opening of the flow guidance path 67*a* facing the glass tube 52 corresponds to the second opening. An opening of the flow guidance path 67*b* facing the inflow port 62*b* corresponds to the third opening. The opening of the flow guidance path 67*b* facing the glass tube 52 corresponds to the fourth opening.

Example 2 of Other Preprocessors

Figure 6B:
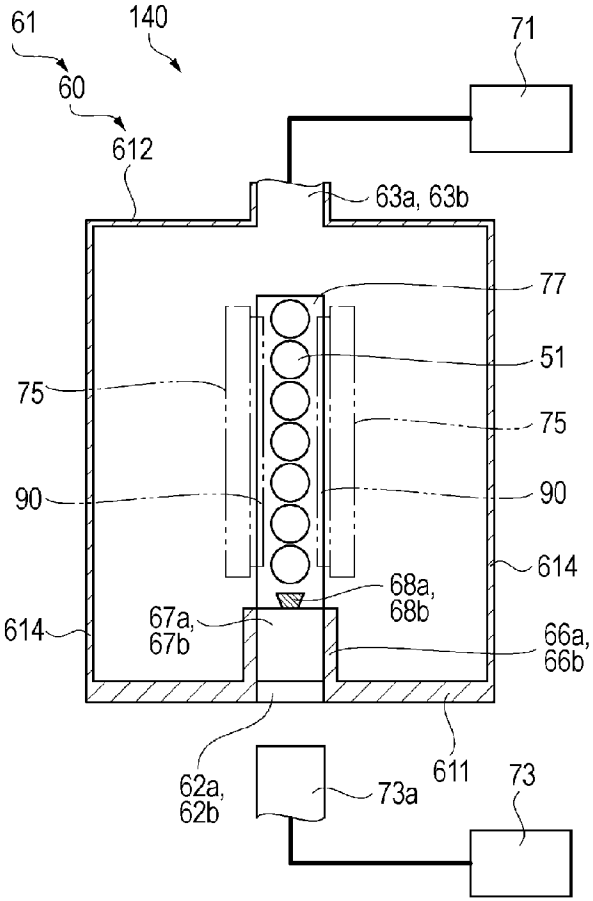
FIG. 6B is a descriptive diagram illustrating the configuration of the preprocessor, in which the shape of a cross section of the chamber cut along a plane approximately orthogonal to the extension direction of the amalgam lamp is illustrated.
Figure 6A:
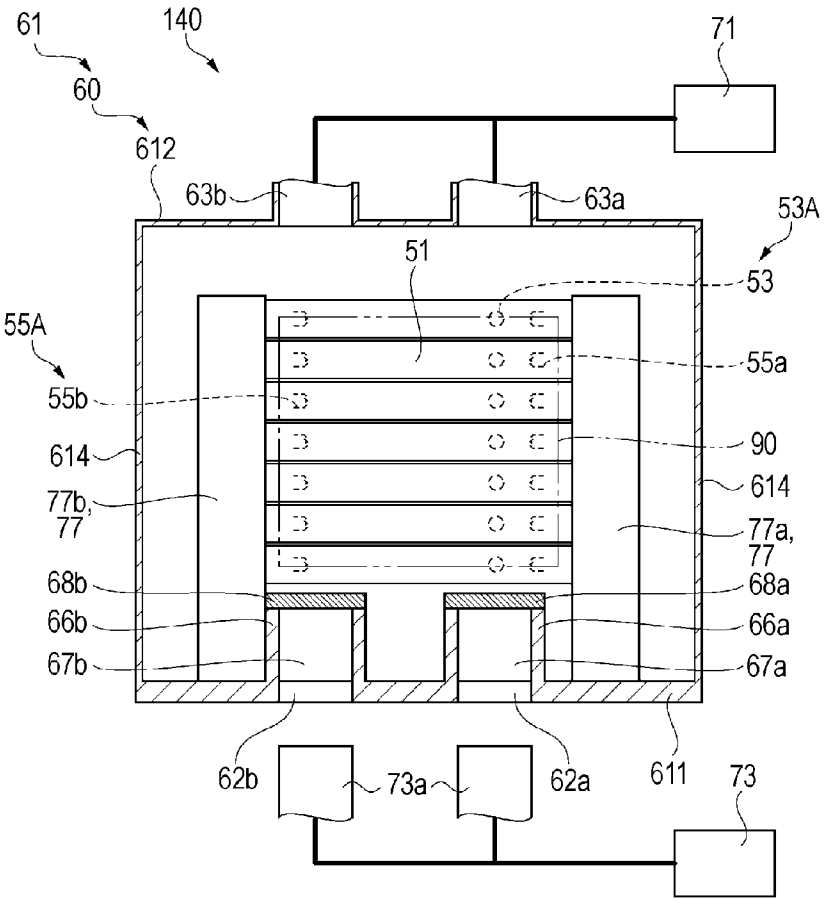
FIG. 6A is a descriptive diagram illustrating the configuration of a preprocessor, in which the shape of a cross section of a chamber cut along a plane approximately parallel to the extension direction of an amalgam lamp is illustrated.

Next, a preprocessor 140 will be described with reference to FIGS. 6A and 6B. Part of the configuration of the preprocessor 140 is different from that of the preprocessor 400 described above. In FIGS. 6A and 6B, same constituent elements as those in FIGS. 5A and 5B are given same reference numerals as those in FIGS. 5A and 5B and descriptions thereof will be omitted. FIGS. 6A and 6B are descriptive diagrams illustrating the configuration of the preprocessor 140. FIG. 6A is a descriptive diagram illustrating the configuration of the preprocessor 140, in which the shape of a cross section of a chamber cut along a plane approximately parallel to the extension direction of the amalgam lamp is illustrated; and FIG. 6B is a descriptive diagram illustrating the configuration of the preprocessor 140, in which the shape of a cross section of the chamber cut along a plane approximately orthogonal to the extension direction of the amalgam lamp is illustrated. For the sake of simplifying the drawings, only the outer shape of the glass tube 52 is indicated in the amalgam lamp 51 of FIG. 6B.

The preprocessor 140 of FIGS. 6A and 6B differs from the preprocessor 400 of FIGS. 5A and 5B in that the main chamber body 60 of the preprocessor 140 further includes flow regulators 68*a* and 68*b*.

The flow regulators 68*a* and 68*b* are each disposed on the upper surface of the flow guidance member 66*a* or 66*b*. The flow regulators 68*a* and 68*b* have an approximately rectangle-shaped cross section in a direction approximately parallel to the opening of the flow guidance path 67*a* or 67*b*, and are disposed across the opening of the flow guidance path 67*a* or 67*b* so that the opening is being divided into two.

The outflow ports 63*a* and 63*b* are openings formed in the top wall 612.

The flow regulator 68*a* is provided extending on the upper surface of the flow guidance member 66*a* approximately in parallel to the extension direction of the amalgam lamp 51 so that the opening of the flow guidance path 67*a* is divided into two approximately equal parts. The width of the flow regulator 68*a* in a direction approximately orthogonal to the extension direction of the amalgam lamp 51 is set smaller than the diameter of the glass tube 52 of the amalgam lamp 51. The width of the flow regulator 68*a* is, for example, approximately two thirds of the diameter of the glass tube 52.

The flow regulator 68*b* is provided extending on the upper surface of the flow guidance member 66*b* approximately in parallel to the extension direction of the amalgam lamp 51 so that the opening of the flow guidance path 67*b* is divided into two approximately equal parts. The width of the flow regulator 68*b* in a direction approximately orthogonal to the extension direction of the amalgam lamp 51 is set smaller than the diameter of the glass tube 52 of the amalgam lamp 51. The width of the flow regulator 68*b* is, for example, approximately two thirds of the diameter of the glass tube 52.

Since the flow regulator 68*a* extends approximately in parallel to the extension direction of the amalgam lamp 51 and divides the opening of the flow guidance path 67*a* into two approximately equal parts, air that flows out from the flow guidance path 67*a* is divided into two streams. At the amalgam lamp 51 which is the closest to the flow regulator 68*a*, of a portion of the glass tube 52 facing the flow regulator 68*a*, the vicinity of the center of the glass tube 52 in a diameter direction thereof is located at a position where the air flow is blocked by the flow regulator 68*a*. Accordingly, the amount of air that is blown onto the glass tube 52 is restricted by the flow regulator 68*a*. The air which has been divided into two streams by the flow regulator 68*a* and flows toward the outflow port 63*a* moves along both sides of the wall formed of the seven amalgam lamps 51 that are arranged in a wall-like form. Because the width of the flow regulator 68*a* is, for example, around two thirds of the diameter of the glass tube 52, the flow of the air is such that it blows against the glass tubes 52 while flowing without departing from the wall formed of the seven amalgam lamps 51.

The flow regulator 68*a* corresponds to the first flow regulator.

Since the flow regulator 68*b* extends approximately in parallel to the extension direction of the amalgam lamp 51 and divides the opening of the flow guidance path 67*b* into two approximately equal parts, air that flows out from the flow guidance path 67*b* is divided into two streams. At the amalgam lamp 51 which is the closest to the flow regulator 68*b*, of a portion of the glass tube 52 facing the flow regulator 68*b*, the vicinity of the center of the glass tube 52 in the diameter direction thereof is located at a position where the air flow is blocked by the flow regulator 68*b*. Accordingly, the amount of air that is blown onto the glass tube 52 is restricted by the flow regulator 68*b*. The air which has been divided into two streams by the flow regulator 68*b* and flows toward the outflow port 63*b* moves along both the sides of the wall formed of the seven amalgam lamps 51 that are arranged in the wall-like form. Because the width of the flow regulator 68*b* is, for example, around two thirds of the diameter of the glass tube 52, the flow of the air is such that it blows against the glass tubes 52 while flowing without departing from the wall formed of the seven amalgam lamps 51.

The flow regulator 68*b* corresponds to the second flow regulator.

Example of Other Amalgam Lamps

Figure 4:
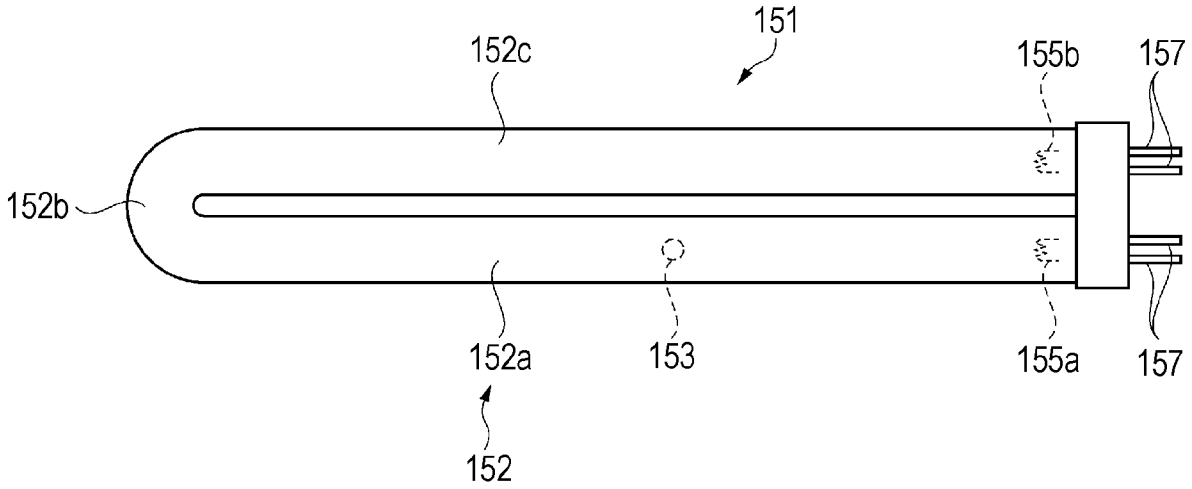
FIG. 4 is a descriptive diagram illustrating the principal configuration of an amalgam lamp.

Next, an amalgam lamp 151 having a different external shape from that of the amalgam lamp 51 described above will be described with reference to FIG. 4. FIG. 4 is a descriptive diagram illustrating the principal configuration of the amalgam lamp 151.

As shown in FIG. 4, the amalgam lamp 151 includes a glass tube 152 that is bent at its center. The glass tube 152 has a circular arc tube portion 152*b* at the center, and linear tube portions 152*a* and 152*c* each connected to each of both ends of the circular arc tube portion 152*b*. In the circular arc tube portion 152*b*, the central axis line of the tube forms a circular arc shape with a central angle of 180 degrees. The tubal central axes of the linear tube portions 152*a* and 152*c* extending from each of both the ends of the circular arc tube portion 152*b* are approximately parallel to each other. The glass tube 152 is a tube formed of quartz glass and both ends of the tube are sealed. The interior of the glass tube 152 is filled with argon gas. A discharge electrode 155*a* is disposed at an end of the interior of the linear tube portion 152*a*, and a discharge electrode 155*b* is disposed at an end of the interior of the linear tube portion 152*c*. Both ends of the discharge electrode 155*a* and both ends of the discharge electrode 155*b* are electrically connected with electrode pins 157, respectively. An amalgam spot 153 configured of a mercury amalgam disposed in the form of an island is formed on the inner wall of the linear tube portion 152*a*.

By connecting the discharge electrode 155*a* or 155*b* with a power supply via the electrode pins 157 and making an electric current flow in the discharge electrode 155*a* or 155*b*, electrons are emitted from the discharge electrode 155*a* or 155*b*. The emitted electrons move to the discharge electrode 155*a* or 155*b* on the opposite side, which causes discharge to start. Electrons that are caused to flow by the discharge collide with mercury electrons. The mercury electrons generate ultraviolet light when collided with the electrons. Since an AC source is used as the power supply, the discharge electrodes 155*a* and 155*b* are formed in approximately the same shape.

The amalgam lamp 151 corresponds to the light source. The glass tube 152 corresponds to the light source tube. The amalgam spot 153 corresponds to the amalgam alloy member. An extension direction of the linear tube portions 152*a* and 152*c* corresponds to the extension direction of the light source tube.

Hereinafter, effects of the embodiment will be described. According to the embodiment, the following effects can be obtained.

1. In the preprocessor 40, the inflow port 62*a* is opened under the seven amalgam spots 53, and the outflow port 63*a* is opened above the seven amalgam spots 53. This causes the outer surface of the part of the glass tube 52 where the amalgam spot 53 is disposed to be positioned in an air flow from the inflow port 62*a* to the outflow port 63*a*. With this, the temperature of the amalgam spot 53 can be adjusted by blowing the air that flows from the inflow port 62*a* to the outflow port 63*a* onto the outer surface of the part of the glass tube 52 where the amalgam spot 53 is disposed. For example, it is possible to efficiently suppress an increase in temperature of the amalgam spot 53 when the amalgam lamp 51 carries out light emission. By suppressing the increase in temperature of the amalgam spot 53, it is possible to suppress a decrease in light emission efficiency of the amalgam lamp 51 due to an excessively increased temperature of the amalgam spot 53.

2. In the preprocessor 40, the inflow port 62*b* is opened under the seven discharge electrodes 55*b*, and the outflow port 63*b* is opened above the seven discharge electrodes 55*b*. This causes the outer surface of the portion of the glass tube 52 where the discharge electrode 55*b* is disposed to be positioned in an air flow from the inflow port 62*b* to the outflow port 63*b*. With this, the temperature of the discharge electrode 55*b* can be adjusted by blowing the air that flows from the inflow port 62*b* to the outflow port 63*b* onto the outer surface of the portion of the glass tube 52 where the discharge electrode 55*b* is disposed. For example, it is possible to efficiently suppress an increase in temperature of the discharge electrode 55*b* when the amalgam lamp 51 carries out light emission. By suppressing the increase in temperature of the discharge electrode 55*b*, it is possible to prevent the lifespan of the amalgam lamp 51 from being shortened due to an excessively increased temperature of the discharge electrode 55*b*.

3. The preprocessor 40 includes the temperature adjustment unit 73, and most of the air that flows into the main chamber body 60 or the like through the inflow ports 62*a*, 62*b* or the like is the air whose temperature has been adjusted by the temperature adjustment 73. Adjusting the temperature of the air that flows into the main chamber body 60 or the like by the temperature adjustment unit 73 makes it possible to adjust the temperature of the amalgam spot 53, the discharge electrode 55*b* and the like to an appropriate temperature with ease.

4. In the preprocessor 40, the outer surface of the part of the glass tube 52 where the amalgam spot 53 is disposed in the amalgam lamp 51, is located in the air flow from the inflow port 62*a* to the outflow port 63*a*. In the amalgam lamp 51, the amalgam spot 53 is formed at a position near the discharge electrode 55*a*. With this configuration, part of the air flow from the inflow port 62*a* to the outflow port 63*a* blows against the outer surface of the portion of the glass tube 52 where the discharge electrode 55*a* is disposed. Accordingly, by providing the inflow port 62*a* and the outflow port 63*a*, the temperature of the discharge electrode 55*a* can be adjusted. This makes the configuration of the main chamber body 60 simpler in comparison with a case where an additional inflow port and an additional outflow port are provided to adjust the temperature of the discharge electrode 55*a* in the configuration.

5. In the preprocessor 40, the outflow ports 63*a* and 63*b* are openings formed in the top wall 612. The inflow ports 62*a* and 62*b* are openings formed in the floor wall 611. Air that flows in through the inflow ports 62*a*, 62*b* and whose temperature has been increased because of the air having cooled the amalgam spot 53, the discharge electrode 55*b* and the like, is likely to move upward. Therefore, such air is likely to be guided toward the outflow ports 63*a* and 63*b* that are opened to the upper side. This can cause the air that flows in through the inflow ports 62*a* and 62*b* to flow out with ease through the outflow ports 63*a* and 63*b*.

6. The preprocessor 400 is equipped with the flow guidance member 66*a* including the flow guidance path 67*a*. One end of the flow guidance path 67*a* is opened extremely near the amalgam lamp 51 while facing the outer surface of the part of the glass tube 52 where the amalgam spot 53 is formed, and the other end thereof communicates with the inflow port 62*a*; further, the inflow port 62*a* and the flow guidance path 67*a* in combination penetrate from the outer surface to the inner surface of the main chamber body 60. This makes it possible to guide the air that flows in from exterior of the main chamber body 60 via the inflow port 62*a* to the vicinity of the outer surface of the part of the glass tube 52 where the amalgam spot 53 is formed.

7. In the preprocessor 400, the flow guidance path 67*a* is opened under the seven amalgam spots 53, and the outflow port 63*a* is opened above the seven amalgam spots 53. The opening of the flow guidance path 67*a* and the outflow port 63*a* are arranged sandwiching the amalgam spot row 53A in the extension direction of the amalgam spot row 53A. With this, an air flow from the flow guidance path 67*a* to the outflow port 63*a* flows along the amalgam spot row 53A, and the outer surface of the part of the glass tube 52 where the amalgam spot 53 is disposed is positioned in the air flow from the flow guidance path 67*a* to the outflow port 63*a*. This makes it possible to adjust the temperature of the amalgam spot 53 by blowing the air that flows from the flow guidance path 67*a* to the outflow port 63*a* onto the outer surface of the part of the glass tube 52 where the amalgam spot is disposed. For example, it is possible to efficiently suppress an increase in temperature of the amalgam spot 53 when the amalgam lamp 51 carries out light emission. By suppressing the increase in temperature of the amalgam spot 53, it is possible to prevent a decrease in light emission efficiency of the amalgam lamp 51 due to an excessively increased temperature of the amalgam spot 53.

8. The preprocessor 400 is equipped with the flow guidance member 66*b* including the flow guidance path 67*b*. One end of the flow guidance path 67*b* is opened extremely near the amalgam lamp 51 while facing the outer surface of the portion of the glass tube 52 where the discharge electrode 55*b* is formed, and the other end thereof communicates with the inflow port 62*b*; further, the inflow port 62*b* and the flow guidance path 67*b* in combination penetrate from the outer surface to the inner surface of the main chamber body 60. This makes it possible to guide the air that flows in from exterior of the main chamber body 60 via the inflow port 62*b* to the vicinity of the outer surface of the portion of the glass tube 52 where the discharge electrode 55*b* is formed.

9. In the preprocessor 400, the flow guidance path 67*b* is opened under the seven discharge electrodes 55*b*, and the outflow port 63*b* is opened above the seven discharge electrodes 55*b*. The opening of the flow guidance path 67*b* and the outflow port 63*b* are arranged sandwiching the discharge electrode row 55A in the extension direction of the discharge electrode row 55A. With this, an air flow from the flow guidance path 67*b* to the outflow port 63*b* flows along the discharge electrode row 55A, and the outer surface of the portion of the glass tube 52 where the discharge electrode 55*b* is disposed is positioned in the air flow from the flow guidance path 67*b* to the outflow port 63*b*. The inflow port 62*b* is opened under the seven discharge electrodes 55*b*, and the outflow port 63*b* is opened above the seven discharge electrodes 55*b*. This causes the outer surface of the portion of the glass tube 52 where the discharge electrode 55*b* is disposed to be positioned in the air flow from the flow guidance path 67*b* to the outflow port 63*b*. With this, the temperature of the discharge electrode 55*b* can be adjusted by blowing the air that flows from the flow guidance path 67*b* to the outflow port 63*b* onto the outer surface of the portion of the glass tube 52 where the discharge electrode 55*b* is disposed. For example, it is possible to efficiently suppress an increase in temperature of the discharge electrode 55*b* when the amalgam lamp 51 carries out light emission. By suppressing the increase in temperature of the discharge electrode 55*b*, it is possible to prevent the lifespan of the amalgam lamp 51 from being shortened due to an excessively increased temperature of the discharge electrode 55*b*.

10. The preprocessor 140 includes the flow regulator 68*a*. Since the flow regulator 68*a* extends approximately in parallel to the extension direction of the amalgam lamp 51 and divides the opening of the flow guidance path 67*a* into two approximately equal parts, air that flows out from the flow guidance path 67*a* is divided into two streams. At the amalgam lamp 51 which is the closest to the flow regulator 68*a*, the air flow is blocked by the flow regulator 68*a* so that the amount of air that is blown onto the glass tube 52 is restricted. The air which has been divided into two streams by the flow regulator 68*a* and flows toward the outflow port 63*a* moves along both the sides of the wall formed of the seven amalgam lamps 51 that are arranged in the wall-like form. With this, it is possible to prevent the amount of air that is blown onto each of the seven amalgam lamps 51 from fluctuating for each of the amalgam lamps 51.

11. The preprocessor 140 includes the flow regulator 68*b*. Since the flow regulator 68*b* extends approximately in parallel to the extension direction of the amalgam lamp 51 and divides the opening of the flow guidance path 67*b* into two approximately equal parts, air that flows out from the flow guidance path 67*b* is divided into two streams. At the amalgam lamp 51 which is the closest to the flow regulator 68*b*, the air flow is blocked by the flow regulator 68*b* so that the amount of air that is blown onto the glass tube 52 is restricted. The air which has been divided into two streams by the flow regulator 68*b* and flows toward the outflow port 63*b* moves along both the sides of the wall formed of the seven amalgam lamps 51 that are arranged in the wall-like form. With this, it is possible to prevent the amount of air that is blown onto each of the seven amalgam lamps 51 from fluctuating for each of the amalgam lamps 51.

12. The preprocessor 140 includes the flow regulator 68*a*. Since the flow regulator 68*a* extends approximately in parallel to the extension direction of the amalgam lamp 51 and divides the opening of the flow guidance path 67*a* into two approximately equal parts, air that flows out from the flow guidance path 67*a* is divided into two streams. The width of the flow regulator 68*a* is around two thirds of the diameter of the glass tube 52. This makes it possible to cause the flow of the air having been divided into two streams by the flow regulator 68*a* to blow against the glass tubes 52 without departing from the wall formed of the seven amalgam lamps 51.

13. The preprocessor 140 includes the flow regulator 68*b*. Since the flow regulator 68*b* extends approximately in parallel to the extension direction of the amalgam lamp 51 and divides the opening of the flow guidance path 67*b* into two approximately equal parts, air that flows out from the flow guidance path 67*b* is divided into two. The width of the flow regulator 68*b* is around two thirds of the diameter of the glass tube 52. This makes it possible to cause the flow of the air having been divided into two streams by the flow regulator 68*b* to blow against the glass tubes 52 without departing from the wall formed of the seven amalgam lamps 51.

14. The preprocessor 400 and the preprocessor 140 include the temperature adjustment unit 73, and most of the air that flows into the main chamber body 60 or the like through the inflow ports 62*a*, 62*b* or the like is the air whose temperature has been adjusted by the temperature adjustment unit 73. Adjusting the temperature of the air that flows into the main chamber body 60 or the like by the temperature adjustment unit 73 makes it possible to adjust the temperature of the amalgam spots 53 and 153, the discharge electrodes 55*b*, 155*a*, 155*b*, and the like to an appropriate temperature with ease.

15. In the preprocessor 400 and the preprocessor 140, the outer surface of the part of the glass tube 52 where the amalgam spot 53 is disposed in the amalgam lamp 51, is located in the air flow from the flow guidance path 67*a* or the like to the outflow port 63*a* or the like. In the amalgam lamp 51, the amalgam spot 53 is formed at a position near the discharge electrode 55*a*. With this configuration, part of the air flow from the flow guidance path 67*a* or the like to the outflow port 63*a* or the like blows against the outer surface of the portion of the glass tube 52 where the discharge electrode 55*a* is disposed. Accordingly, by providing the flow guidance member 66*a* including the flow guidance path 67*a*, or the like and the outflow port 63*a* or the like, the temperature of the discharge electrode 55*a* can be adjusted. This makes the configuration of the main chamber body 60 simpler in comparison with a case where the flow guidance member 66*a* including the flow guidance path 67*a*, or the like and the outflow port 63*a* or the like are additionally provided to adjust the temperature of the discharge electrode 55*a* in the configuration.

16. In the preprocessor 400 and the preprocessor 140, the outflow ports 63*a* and 63*b* are openings formed in the top wall 612. The flow guidance member 66*a* including the flow guidance path 67*a* is formed in the floor wall 611. The flow guidance member 66*b* including the flow guidance path 67*b* is also formed in the floor wall 611. Air that flows in from the flow guidance paths 67*a* and 67*b*, or the like and whose temperature has been increased because of the air having cooled the amalgam spot 53, the discharge electrode 55*b* and so on, is likely to move upward. Therefore, such air is likely to be guided toward the outflow port 63*a* that is opened to the upper side. This can cause the air that flows in from the flow guidance path 67*a* or the like to flow out with ease through the outflow port 63*a* or the like.

Thus far, a preferred embodiment has been described referring to the appended drawings. However, preferred embodiments are not limited to the embodiment described above. It is obvious that various kinds of variations can be made on the above-described embodiment without departing from the spirit and scope of the invention as follows.

Variation 1

In the above-described embodiment, the preprocessors 40, 400 and 140 as the irradiation devices are a device that modifies a property of the print surface 92 to make it lyophilic, for example, with respect to the functional liquid 9 used for printing an image. However, the irradiation devices as indicated in the above embodiment are not limited to be used only for the preprocessing and property modification of a target surface; they can be also used as a cleaning device for removing foreign matter on the target surface, a disinfection device for disinfecting the target surface, a curing device that irradiates curing light to cure a light curing-type functional liquid, and so on.

Variation 2

In the above-described embodiment, the main chamber body 60 in the preprocessor 40 as the irradiation device includes the inflow port 62*b* and the outflow port 63*b* for adjusting the temperature of the discharge electrode 55*b*. However, it is not essential to provide the second gas inflow port and the second gas outflow port in the main chamber body in the following manner; that is, the second gas inflow port and the second gas outflow port are so arranged as to form a flow path of a gas that flows in through the second gas inflow port and flows out through the second gas outflow port, and the outer surface of a portion of the light source tube where a discharge electrode is disposed is positioned in the formed flow path. The irradiation device may have a configuration in which the main chamber body includes the first gas inflow port and the first gas outflow port but does not include the second gas inflow port and the second gas outflow port.

Variation 3

In the above-described embodiment, the main chamber body 60 of the preprocessor 40 as the irradiation device includes a set of the inflow port 62*b*, the outflow port 63*b*, and the like for adjusting the temperature of the discharge electrodes 55*b*. However, it is not essential that the main chamber body includes only one set of the second gas inflow port and the second gas outflow port. Like in the preprocessor 40 equipped with the discharge electrode row 55A of the discharge electrodes 55*a* and the discharge electrode row 55A of the discharge electrodes 55*b*, in an irradiation device where a plurality of discharge electrodes are disposed at positions separated from each other, a configuration in which plural sets of the second gas inflow port and the second gas outflow port are provided may be employed.

Variation 4

In the above-described embodiment, the preprocessors 40, 400, and 140 each include the seven amalgam lamps 51 as the light sources. However, the number of light sources to be included in an irradiation device is not limited to seven. Any number of light sources may be included in the irradiation device.

Variation 5

In the above-described embodiment, the amalgam spot row 53A and the discharge electrode row 55A extend in the vertical direction. However, in an irradiation device where a plurality of amalgam alloy members and plural sets of discharge electrodes are included, it is not essential that the arrangement direction of amalgam alloy members, discharge electrodes and the like is needed to be vertical. In such irradiation device, the arrangement direction of amalgam alloy members, discharge electrodes and the like may be horizontal, or tilted relative to the vertical or horizontal direction.

Variation 6

In the above-described embodiment, the main chamber body 60 of the preprocessor 40 as the irradiation device includes a set of the inflow port 62*a* as the first gas inflow port and the outflow port 63*a* as the first gas outflow port. However, the number of first gas inflow ports or first gas outflow ports included in the main chamber body of an irradiation device is not limited to one. In an irradiation device in which a large number of light sources are provided and the outer surface of a part of each light source tube where an amalgam alloy member is disposed is located at each separate position, a configuration in which the main chamber body includes a plurality of the first gas inflow ports and outflow ports may be employed.

Variation 7

In the above-mentioned embodiment, the main chamber body 60 of the preprocessor 40 as the irradiation device includes a single outflow port 63*a* as the first gas outflow port with respect to a single inflow port 62*a* as the first gas inflow port. However, it is not essential to configure a set of components in which a single first gas inflow port and a single first gas outflow port are included in combination. A configuration in which a plurality of first gas outflow ports or first gas inflow ports with respect to a single first gas inflow port or a single first gas outflow port are set in combination as a pair, may be employed.

Variation 8

In the above-described embodiment, the preprocessors 40, 400 and 140 each include a single suction pump 71, and suck the air from the interior of the main chamber body 60 through a plurality of outflow ports such as the outflow ports 63*a* and 63*b* using the single suction pump 71. However, the number of suction units included in an irradiation device is not limited to one. The irradiation device may include a plurality of suction units. There may be provided a configuration in which suction units are provided respectively to the first gas outflow port and the second gas outflow port. By providing the suction units respectively to the first gas outflow port and the second gas outflow port, the temperatures of the corresponding amalgam alloy members and discharge electrodes can be individually adjusted with ease.

Variation 9

In the above-described embodiment, the preprocessors 40, 400 and 140 each include the temperature adjustment unit 73. However, it is not essential for the irradiation device to include a gas temperature adjustment unit. There may be provided a configuration in which the temperature of a gas that flows into the main chamber body is not specifically adjusted.

Variation 10

In the above-described embodiment, the preprocessors 40, 400 and 140 each include a single temperature adjustment unit 73, and uniformly adjust the temperature of air that flows into the main chamber body 60 through a plurality of inflow ports such as the inflow ports 62*a* and 62*b* using the single temperature adjustment unit 73. However, the number of gas temperature adjustment units included in an irradiation device is not limited to one. The irradiation device may include a plurality of gas temperature adjustment units. There may be provided a configuration in which gas temperature adjustment units are provided for each of the first gas inflow port and the second gas inflow port. By providing the gas temperature adjustment units for each of the first gas inflow port and the second gas inflow port, the temperature of air that flows in may be varied individually for each corresponding amalgam alloy member and discharge electrode.

Variation 11

The preprocessors 40, 400 and 140 of the above-described embodiment may be rotated by 90 degrees. In other words, the preprocessor 40 is rotated to be configured such that the floor wall 611 and the top wall 612 of the preprocessor 40 become the side walls, either one of the side walls 614 of the preprocessor 40 becomes the floor wall, and the other side wall 614, which is opposed to the newly set floor wall, becomes the top wall.

Variation 12

The amalgam lamp 51 used in the preprocessors 40, 400 and 140 of the above-described embodiment may be replaced with the amalgam lamp 151 described above as an example of other amalgam lamps.

Variation 13

In the above-described embodiment, the main chamber body 60 of the preprocessors 400 and 140 as the irradiation devices has the flow guidance member 66*b* including the flow guidance path 67*b* for adjusting the temperature of the discharge electrode 55*b* and the outflow port 63*b*. However, it is not essential that the main chamber body should include the second gas inflow port and the second gas outflow port, and the second flow guidance member that guides a gas flowing into the main chamber body through the second gas inflow port to a direction in which the gas is blown onto the outer surface of a portion of the light source tube where the discharge electrode is disposed. An irradiation device may have a configuration in which the main chamber body includes the first gas inflow port, the first gas outflow port and the first flow guidance member, but does not include the second gas inflow port, the second gas outflow port and the second flow guidance member.

Variation 14

In the above-described embodiment, the main chamber body 60 of the preprocessors 400 and 140 as the irradiation devices has a set of the flow guidance member 66*b* including the flow guidance path 67*b* for adjusting the temperature of the discharge electrode 55*b* and the outflow port 63*b*. However, it is not essential that the main chamber body should include only one set of the second gas inflow port, the second outflow port and the second flow guidance member. Like in the preprocessors 400 and 140 each having the discharge electrode row 55A of the discharge electrodes 55*a* and the discharge electrode row 55A of the discharge electrodes 55*b*, in an irradiation device where a plurality of discharge electrodes are arranged at positions separated from each other, the irradiation device may have a configuration that includes a plurality of sets of the second gas inflow port, the second gas outflow port and the second flow guidance member.

Variation 15

In the above-described embodiment, the main chamber body 60 of the preprocessors 400 and 140 as the irradiation devices has a set of the inflow port 62*a* as the first gas inflow port, the flow guidance member 66*a* as the first flow guidance member, and the outflow port 63*a* as the first gas outflow port in combination. However, the main chamber body of an irradiation device is not limited to have a single first gas inflow port, a single first gas outflow port and a single flow guidance member. In an irradiation device in which a large number of light sources are provided and the outer surface of a part of each light source tube where an amalgam alloy member is disposed is arranged at each separate position, the main chamber body may have a configuration that includes a plurality of the first gas inflow and outflow ports and the first flow guidance members.

Variation 16

In the above-described embodiment, the main chamber body 60 of the preprocessors 400 and 140 as the irradiation devices includes a single outflow port 63*a* as a gas outflow port with respect to a single flow guidance member 66*a* as a flow guidance member. However, it is not essential to configure a set of components in which a single flow guidance member and a single gas outflow port are included in combination. A configuration in which a plurality of gas outflow ports or flow guidance members with respect to a single flow guidance member or gas outflow port are set in combination as a pair, may be employed.

The entire disclosure of Japanese Patent Application No.: 2011-249409, filed Nov. 15, 2011 and 2011-249410, filed Nov. 15, 2011 are expressly incorporated by reference herein.

What is claimed is:

1. An irradiation device comprising:

a light source having an amalgam alloy member that is disposed on a part of the inner surface of a light source tube; and a chamber in which the light source is disposed, wherein the chamber includes:

a main chamber body; and a first gas inflow port and a first gas outflow port that are formed in the main chamber body, and wherein the first gas inflow port and the first gas outflow port are arranged so that the outer surface of the part of the light source tube where the amalgam alloy member is disposed is positioned in a flow path of a gas that flows in through the first gas inflow port and flows out through the first gas outflow port, wherein the first gas inflow port and the first gas outflow port are arranged at the positions sandwiching the amalgam alloy member between the first gas inflow port and the first gas outflow port in a direction that intersects with an extension direction of the light source tube, wherein the light source is equipped with a discharge electrode, and the chamber further includes a second gas inflow port and a second gas outflow port that are formed in the main chamber body, and wherein the second gas inflow port and the second gas outflow port are arranged so that the outer surface of a portion of the light source tube where the discharge electrode is disposed is positioned in a flow path of a gas that flows in through the second gas inflow port and flows out through the second gas outflow port.

2. The irradiation device according to claim 1, wherein the first gas outflow port is arranged above the amalgam alloy member in the vertical direction and the first gas inflow port is arranged under the amalgam alloy member in the vertical direction.

3. The irradiation device according to claim 1, wherein the second gas inflow port and the second gas outflow port are arranged at the positions sandwiching the discharge electrode between the second gas inflow port and the second gas outflow port in a direction that intersects with the extension direction of the light source tube.

4. The irradiation device according to claim 3, wherein the second gas outflow port is arranged above the discharge electrode in the vertical direction, and the second gas inflow port is arranged under the discharge electrode in the vertical direction.

5. The irradiation device according to claim 1, wherein the amalgam alloy member is disposed at a position closer to a second end than to a first end, the second end being on the opposite side to the first end in the lengthwise direction of the light source, the discharge electrode is disposed inside the light source tube and includes a first discharge electrode disposed at the first end side and a second discharge electrode disposed at the second end side, and the second gas inflow port and the second gas outflow port are disposed so that the outer surface of a portion of the light source tube where the first discharge electrode is disposed is arranged in a flow path of a gas that flows in through the second gas inflow port and flows out through the second gas outflow port.

6. The irradiation device according to claim 1, further comprising:

a gas temperature adjustment unit that is capable of adjusting the temperature of a gas which is supplied to the main chamber body through at least one of the first gas inflow port and the second gas inflow port.

7. The irradiation device according to claim 1, further comprising:

a suction unit that is capable of sucking a gas out of the main chamber body via at least one of the first gas outflow port and a second gas outflow port.

8. An irradiation method for irradiating light that is emitted from a light source including an amalgam alloy member which is disposed on a part of the inner surface of a light source tube, wherein the outer surface of a part of the light source tube where the amalgam alloy member is disposed is positioned in an air flow path of a gas that flows in through a first gas inflow port formed in a chamber where the light source is disposed and flows out through a first gas outflow port formed in the stated chamber, wherein the outer surface of a second part of the light source tube where a discharge electrode is disposed is positioned in a second air flow path of a gas that flows in through a second gas inflow port formed in the chamber where the light source is disposed and flows out through the second gas outflow port in the stated chamber.

9. An irradiation device comprising:

a light source equipped with an amalgam alloy member that is disposed on a part of the inner surface of a light source tube; and a chamber inside of which the light source is disposed, wherein the chamber includes:

a main chamber body;

a first gas inflow port and a first gas outflow port that are formed in the main chamber body; and a first flow guidance member that guides a gas flowing into the main chamber body through the first gas inflow port to a direction in which the gas is blown onto the outer surface of the part of the light source tube where the amalgam alloy member is disposed, wherein the first flow guidance member includes a first flow guidance path having a first opening at one end thereof being opened facing the first gas inflow port and a second opening at the other end thereof being opened facing the outer surface of the part of the light source tube where the amalgam alloy member is disposed, wherein the first flow guidance member and the first gas outflow port are arranged at the positions sandwiching the amalgam alloy member between the second opening and the first gas outflow port in a direction that intersects with the extension direction of the light source tube.

10. The irradiation device according to claim 9, further comprising:

a first flow regulator that restricts a flow of a gas that has passed through the first flow guidance member against the light source tube between the first flow guidance member and the light source tube.

11. The irradiation device according to claim 10, wherein the width of the first flow regulator is smaller than the outer diameter of the light source tube in a direction which is approximately orthogonal both to the direction of the air flow that flows toward the light source tube from the first flow guidance member and to the extension direction of the light source tube.

12. The irradiation device according to claim 9, wherein the light source includes a discharge electrode, and the chamber further includes: a second gas inflow port and a second gas outflow port that are formed in the main chamber body; and a second flow guidance member that guides a gas flowing into the main chamber body through the second gas inflow port to a direction in which the gas is blown onto the outer surface of the portion of the light source tube where the discharge electrode is disposed.

13. The irradiation device according to claim 12, wherein the second flow guidance member includes a second flow guidance path having a third opening at one end thereof being opened facing the second gas inflow port and a fourth opening at the other end thereof being opened facing the outer surface of the portion of the light source tube where the discharge electrode is disposed.

14. The irradiation device according to claim 13, wherein the second flow guidance member and the second gas outflow port are arranged at the positions sandwiching the discharge electrode between the fourth opening and the second gas outflow port in a direction that intersects with the extension direction of the light source tube.

15. The irradiation device according to claim 13, further comprising:

a second flow regulator that restricts the blow of a gas that has passed through the second flow guidance path against the light source tube between the second flow guidance member and the light source tube.

16. The irradiation device according to claim 15, wherein the width of the second flow regulator is smaller than the outer diameter of the light source tube in a direction which is approximately orthogonal both to the direction of the air flow that flows toward the light source tube from the second flow guidance member and to the extension direction of the light source tube.

* * * * *